US006584874B1

(12) United States Patent
Wade et al.

(10) Patent No.: US 6,584,874 B1
(45) Date of Patent: Jul. 1, 2003

(54) 3-D SPRAG RATCHETING TOOL

(75) Inventors: Michael O. Wade, Sykesville, MD (US); James W. Poland, Jr., Laurel, MD (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 08/673,859

(22) Filed: Jul. 2, 1996

(51) Int. Cl.[7] ..... B25B 13/46
(52) U.S. Cl. ..... 81/60
(58) Field of Search ..... 81/60, 59.1; 192/45.1, 192/41 A

(56) References Cited

U.S. PATENT DOCUMENTS 2,139,650 A * 12/1938 Anderson et al. ..... 81/59.1
3,164,234 A * 1/1965 Tamarin ..... 192/45.1
3,326,342 A * 6/1967 Hack ..... 192/41 A
3,743,066 A * 7/1973 De Lavalette et al. ..... 192/45.1
3,844,391 A * 10/1974 Hallerberg ..... 192/45.1
4,004,666 A * 1/1977 Hinojosa ..... 81/59.1
4,099,430 A * 7/1978 Stodola ..... 81/59.1
4,130,191 A * 12/1978 Judd et al. ..... 192/41 A
4,297,924 A * 11/1981 Stephens ..... 81/59.1
4,360,093 A * 11/1982 Wakabayashi et al. .... 192/41 A
5,115,699 A * 5/1992 Mertens ..... 81/59.1
5,469,949 A * 11/1995 Leitz ..... 192/41 A
5,482,144 A * 1/1996 Vranish ..... 192/45.1
5,518,094 A * 5/1996 Myrick ..... 192/45.1
5,765,669 A * 6/1998 Adams et al. ..... 192/45.1

* cited by examiner

*Primary Examiner*—James G Smith
(74) *Attorney, Agent, or Firm*—Keith Dixon

(57) ABSTRACT

A ratcheting device comprising a driver head assembly which includes at least two 3-D sprag elements positioned within a first groove within the driver head assembly such that at least one of the 3-D sprag elements may lockingly engage the driver head assembly and a mating hub assembly to allow for rotation of the hub assembly in one direction with respect to the driver head assembly. This arrangement allows the ratcheting tool to impart torque in either the clockwise or counterclockwise direction without having to first rotate the ratcheting tool in the direction opposite the direction in which the torque is applied. This arrangement also allows the ratcheting tool to impart torque in either the clockwise or counterclockwise direction while in the neutral position.

10 Claims, 7 Drawing Sheets

(Section A-A)

(Section B-B)

3-D SPRAG RATCHETING TOOL

CROSS REFERENCE TO RELATED PATENTS

This invention relates to an invention disclosed in U.S. Pat. No. 5,482,144, which is assigned to the assignee of this application. The present application incorporates this patent by reference.

ORIGIN OF THE INVENTION

The invention described herein was made by employees of the United States Government, and may be manufactured and used by or for the Government for governmental purposes without the payment of any royalty thereon or therefor.

TECHNICAL FIELD

The present invention relates generally to hand tools and more particularly to ratcheting devices which may be used in one-way and two-way socket wrenches.

BACKGROUND ART

Socket wrenches generally are old and well known for use in any application which requires the loosening or tightening of nuts, bolts and other fastening devices. Socket wrenches typically include some sort of locking mechanism which will allow free motion in one direction while preventing motion in the opposite direction. The prior art locking mechanisms typically include ratcheting devices which are limited by the pitch and spacing of the teeth of the ratcheting wheel or bar. Such a limitation induces a minimum motion requirement in the direction opposite the desired loosening or tightening to move the engaging pawl, click or detent to the next tooth before one is able to impart the torque required to perform the desire loosening or tightening function. If the loosening or tightening function is performed in an area where space is extremely limited then it becomes very difficult to perform such functions because the pitch and spacing of the teeth on the ratcheting wheel or bar would require a minimum amount of movement in the opposite direction before torque is transferred to the object which one desires to loosen or tighten. Further, the prior art socket wrenches are not capable of allowing one to transfer torque in both the clockwise and counterclockwise directions without having to make adjustments to the socket wrench. Thus, one would then have the capability of performing bi-directional fine adjustments during the tightening or loosening function.

STATEMENT OF THE INVENTION

Accordingly it is an object of this invention to provide a new and improved ratcheting device.

It is another object of the present invention to provide an improved ratcheting device which may be used in a hand tool.

It is a further object of the present invention to provide an improved ratcheting device which does not require a minimum movement in the opposite direction before torque can be imparted in the desired It is yet a further object of the present invention to provide an improved ratcheting device which will allow one to impart torque in both the clockwise and counterclockwise directions.

It is still a further object of this invention to provide an improved ratcheting device which includes a neutral setting.

The above and other objects of the present invention are achieved by providing a ratcheting tool comprising a driver head which includes at least two 3-D sprag elements positioned within a first groove within the driver head such that one of the sprag elements may lockingly engage the first groove of the drive head when the driver head is rotated. The ratcheting tool also includes a neck which is integrally formed with the driver head. The ratcheting tool further includes a handle which is integrally formed with the neck such that the handle may cause the driver head to rotate in a clockwise or counterclockwise direction.

DETAILED DESCRIPTION OF THE INVENTION

Figure 1:
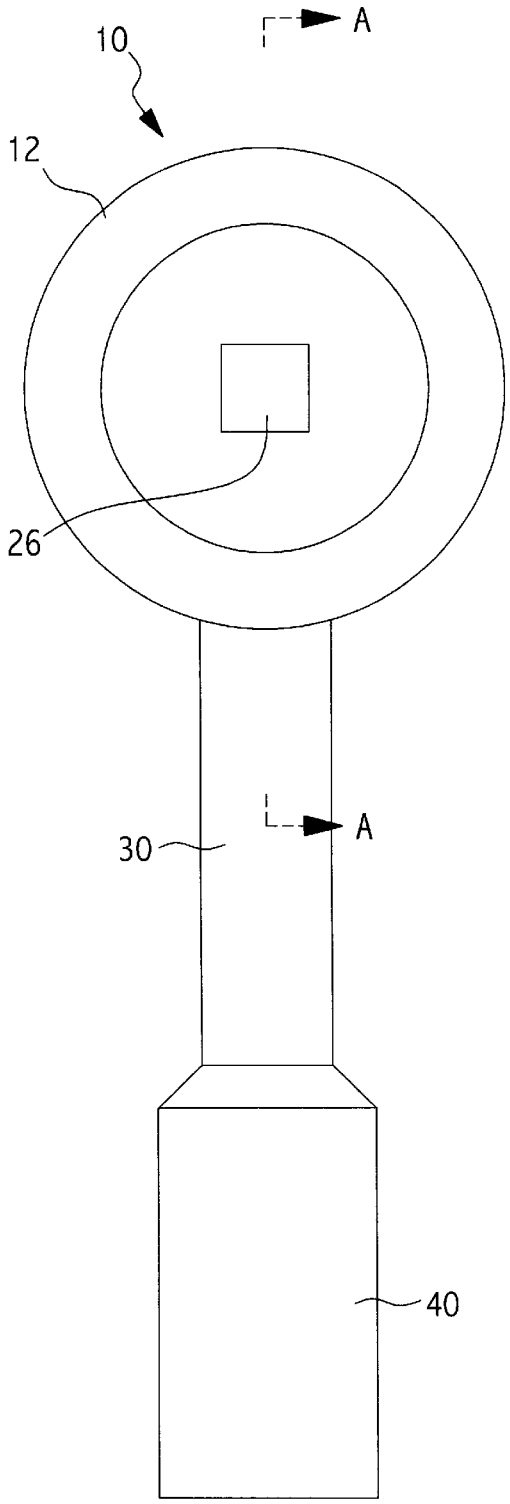
FIG. 1 is a full view of the present invention.
Figure 2:
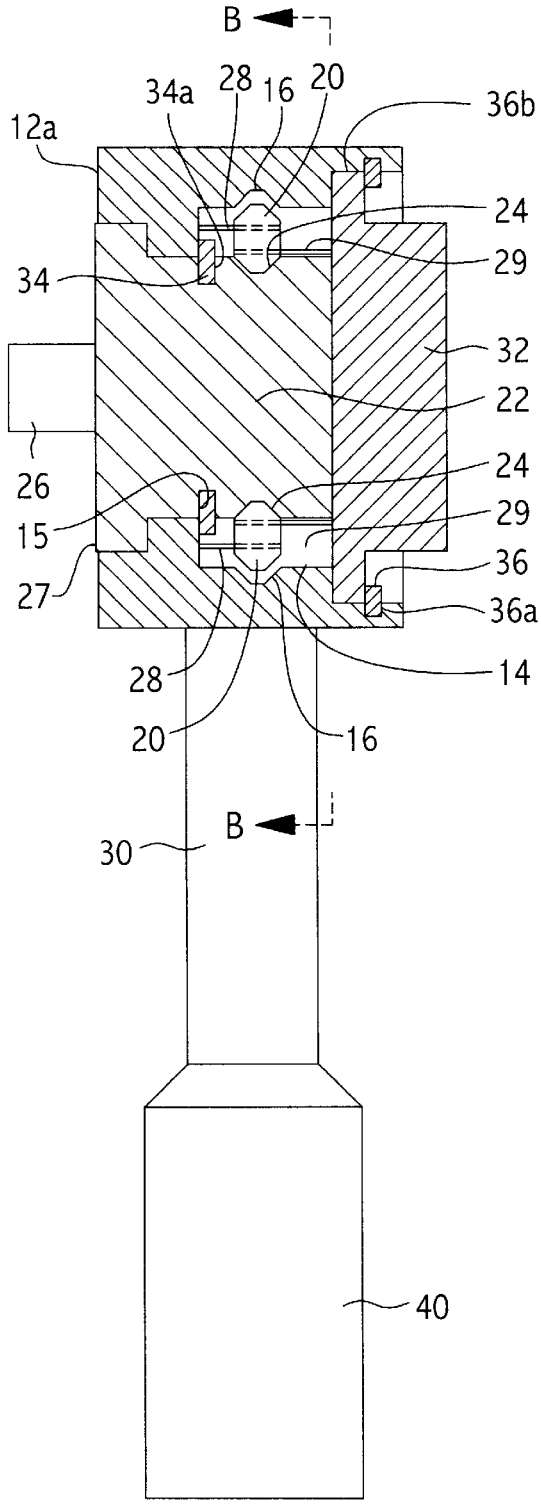
FIG. 2 is a sectional view of the present invention taken along lines A—A of FIG. 1.

Referring now to FIGS. 1 and 2 wherein like reference numerals refer to like elements throughout. Referring now to FIG. 1, a ratchet tool generally shown as 10 includes a driver head 12 a neck 30 and a handle 40. Referring now to FIG. 2, a sectional view of FIG. 1 of the present invention taken along lines A—A, shows a ratchet tool 10 of the present invention wherein the ratchet tool 10 includes driver head 12 which further includes a first groove 16 within bore 14 and a second groove 36*a* which is located within second bore 36*b* of driver head 12. First groove 16 is machined such that it receives beveled surfaces 20*a* of sprag element 20 in a locking engagement. Second bore 36*b* is machined such that it may receive cover 32. Beveled surfaces 20*b* are received by groove 24 of hub assembly 22. Hub assembly 22 is concentrically positioned within driver head 12 and sprag elements 20 are radially positioned with respect to hub assembly 22 within groove 24. Ratchet tool 10 further includes dowel pins 29 which terminate in bore 29*a* (not shown) of cover 32 (see FIG. 6). Dowel pins 29 are secured (by conventional means) within bore 29*a* (not shown) of cover 32. When cover 32 is made to rotate with respect to driver head 12, dowel pins 29 cause sprag elements 20 which are spaced 180 degrees apart to pivot about their respective dowel pins 28. Dowel pins 28 pass freely through bores 28*a* of sprag elements 20 and terminate in driver head 12 of ratchet tool 10 so as to allow the pivoting motion of sprag elements 20. If ratchet tool 10 were to only include two (2) sprag elements 20 then only one dowel pin 29 would be necessary to facilitate the relative rotation of hub assembly 22 in the clockwise and counterclockwise direction. Snap ring 34 is received by groove 34*a* of hub assembly 22 to rotatably hold hub assembly 22 within bore 14 of driver head 12. Snap ring 36 is received by second groove 36*a* of driver head 12 to rotatably hold cover 32 within bore 36*b*. Dowel pins 28 are securely positioned (by conventional means) within driver head 12 of ratchet tool 10. This arrangement allows sprag elements 20 to be slightly rotated within groove 16. A slight rotation in the clockwise direction will prevent rotation of hub assembly 22 in the clockwise direction with respect to driver head 12. A slight rotation in the counterclockwise direction will prevent rotation of hub assembly 22 in the counterclockwise direction. When the dowel pins 28 do not cause a slight rotation in either direction then hub assembly 22 will not rotate in either direction with respect to driver head 12. This is the neutral position. While in the neutral position, driver head 12 may impart torque on a fastening element (not shown) in either the clockwise or counterclockwise directions.

Figure 3:
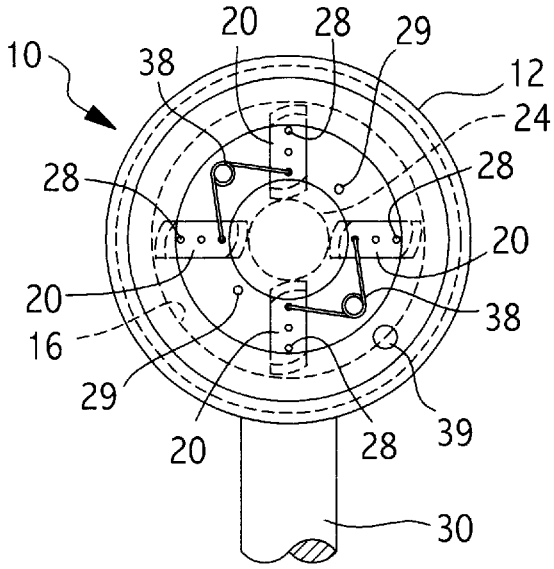
FIG. 3 is a sectional view of the present invention taken along lines B—B of FIG. 2.

Referring now to FIG. 3, a sectional view of FIG. 2 along lines B—B, driver head 12 and hub assembly 22 are shown with sprag elements 20 positioned radially between driver head 12 and hub assembly 22. Preload spring element 38 passes through bore 38*a* of sprag elements 20. The preload springs applies a force to sprag means such that sprag means 20 are slightly biased toward and within groove 24 of hub assembly 22. Preload spring element 38 keeps sprag means 20 in contact with grooves 24 so that hub assembly 22 may rotate freely in one direction while immediately locking if rotation is attempted in the opposite direction. FIG. 3 further shows bore 39 which receives ball bearing (not shown) so as to lock driver head 12 in either the clockwise, counterclockwise or neutral settings.

Figure 4:
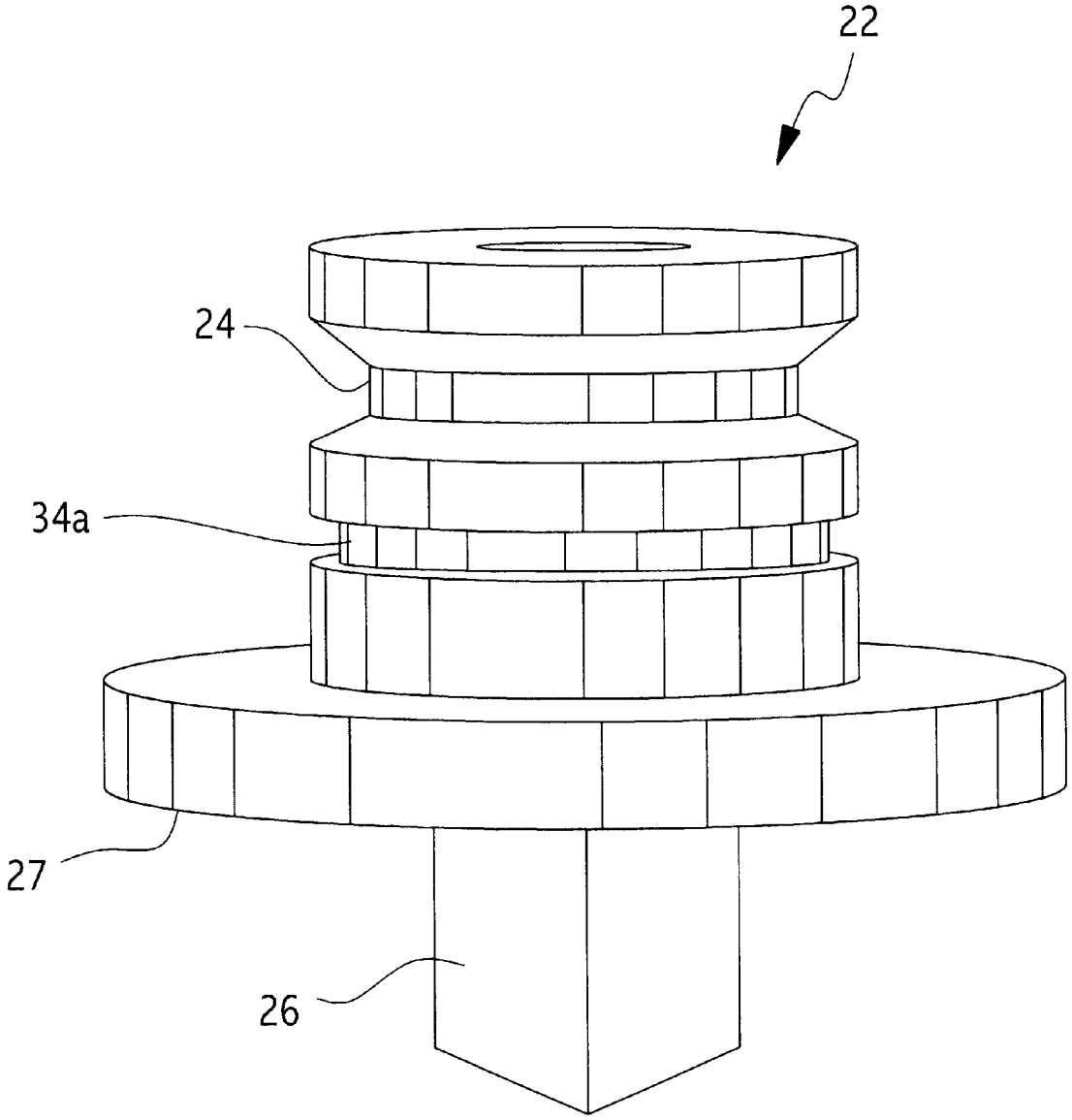
FIG. 4 is a view of the hub assembly of the present invention.

Referring now to FIG. 4, hub assembly 22 includes groove 24 which is machined to receive beveled surfaces 20*a* and 20*b* of sprag elements 20 in locking engagement fashion when driver head 12 is rotated relative to hub assembly 22. Groove 34*a* is used to rotatably secure hub assembly 22 with respect to driver head 12. This is achieved via snap ring 34 (see FIG. 2) which snugly fits in groove 34*a* and abuts against surface 15 within driver head 12. Hub assembly 22 further includes a male element 26 designed to mate with a socket element (not shown) for tightening or loosening any fastening element (not shown). Male element 26 includes a surface/stop 27 which is slightly raised with respect to surface 12*a* of driver head 12.

Figure 5A:
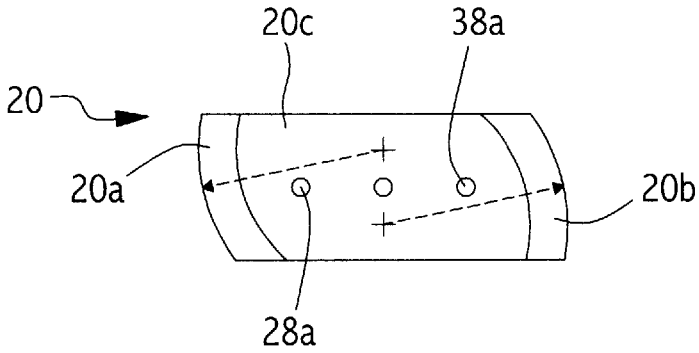
FIG. 5A shows the 3-D sprag elements of the present invention.
Figure 5B:
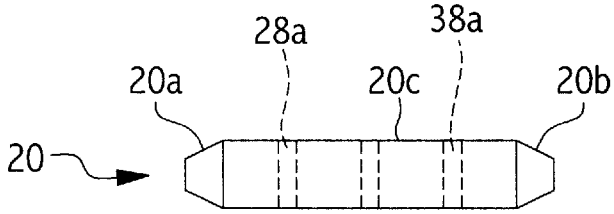
FIG. 5B shows a side view of FIG. 5A

Referring now to FIGS. 5A and 5B, sprag element 20 is shown with greater detail. On the face 20*c* of each sprag element 20 the beveled surfaces 20*a* and 20*b* have bevel arcs which have off-setting centers. Beveled surfaces which are located at a common end of sprag means 20 include bevel arcs with centers which are not off-setting. Thus, bevel arcs which are located at opposite ends of sprag elements 20 have off-setting centers. It is the off-setting centers of these beveled surfaces which allows hub assembly 22 to rotate in one direction with respect to driver head 12 while remaining fixed in the other direction with respect to driver head 12. A slight rotation or pivot of sprag element 20 will allow for rotation of hub assembly 22 in the opposite direction. When there is no rotation or pivot of sprag element 20 then hub assembly 22 will remain locked for rotations in the clockwise and counterclockwise directions thus allowing ratchet tool 10 to transfer torque in either the clockwise or counterclockwise direction. Conventional means (not shown) may be employed such that cover 32 may easily facilitate the selection of direction of rotation of hub assembly 22 with respect to driver head 12. Thus by selectively slightly rotating or pivoting sprag elements 20 which are spaced 180 degrees apart hub assembly 22 will be allowed to rotate with respect to driver head 12 thereby allowing ratchet tool 10 to impart torque in the direction opposite the slight rotation or pivot. In the preferred embodiment ratchet tool 10 may be allowed to impart torque in the clockwise direction or the counterclockwise direction or in both directions.

Figure 6:
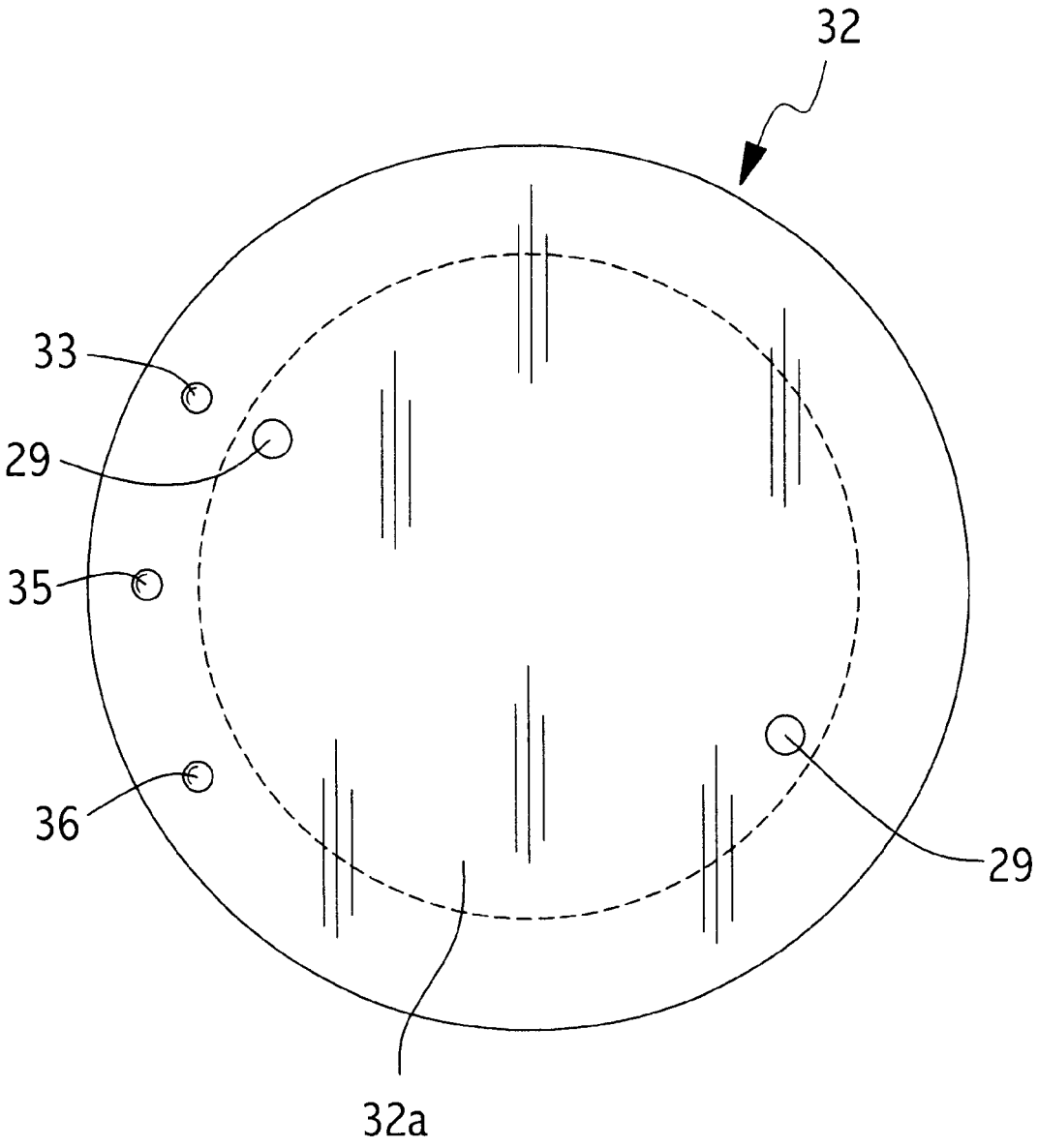
FIG. 6 shows the inside view of the back cover of the present invention.

Referring now to FIG. 6, cover 32 includes surface 32*a* wherein detents 33, 35 and 37 are shown. The purpose of the cover is to enclose the mechanism and provide the means for controlling the direction (clockwise or counterclockwise) of torque applied by ratchet tool 10. Detents 33, 35 and 37 are provided for a roller bearing (not shown) to lock ratchet tool 10 in either the clockwise, counterclockwise or neutral settings. The roller bearing fits within bore 39 (see FIGS. 3 and 7) of driver head 12. This arrangement is common among socket wrenches for setting and locking the wrench at a desired setting. Cover 32 further includes dowel pins 29 (see FIG. 2) which pivot sprag means 20 to achieve the desired setting (clockwise, counterclockwise or neutral) when cover 32 is rotated. Cover 32 includes bores 29*a* (not shown) which securely hold dowel pins 29. Dowel pins 29 are located such that a rotation of the cover causes the pins to push against a pair of similarly oriented sprags, compressing preload spring elements 38 thereby disengaging that pair of sprags thus allowing for rotation in one direction and locking in the opposite direction.

Figure 7:
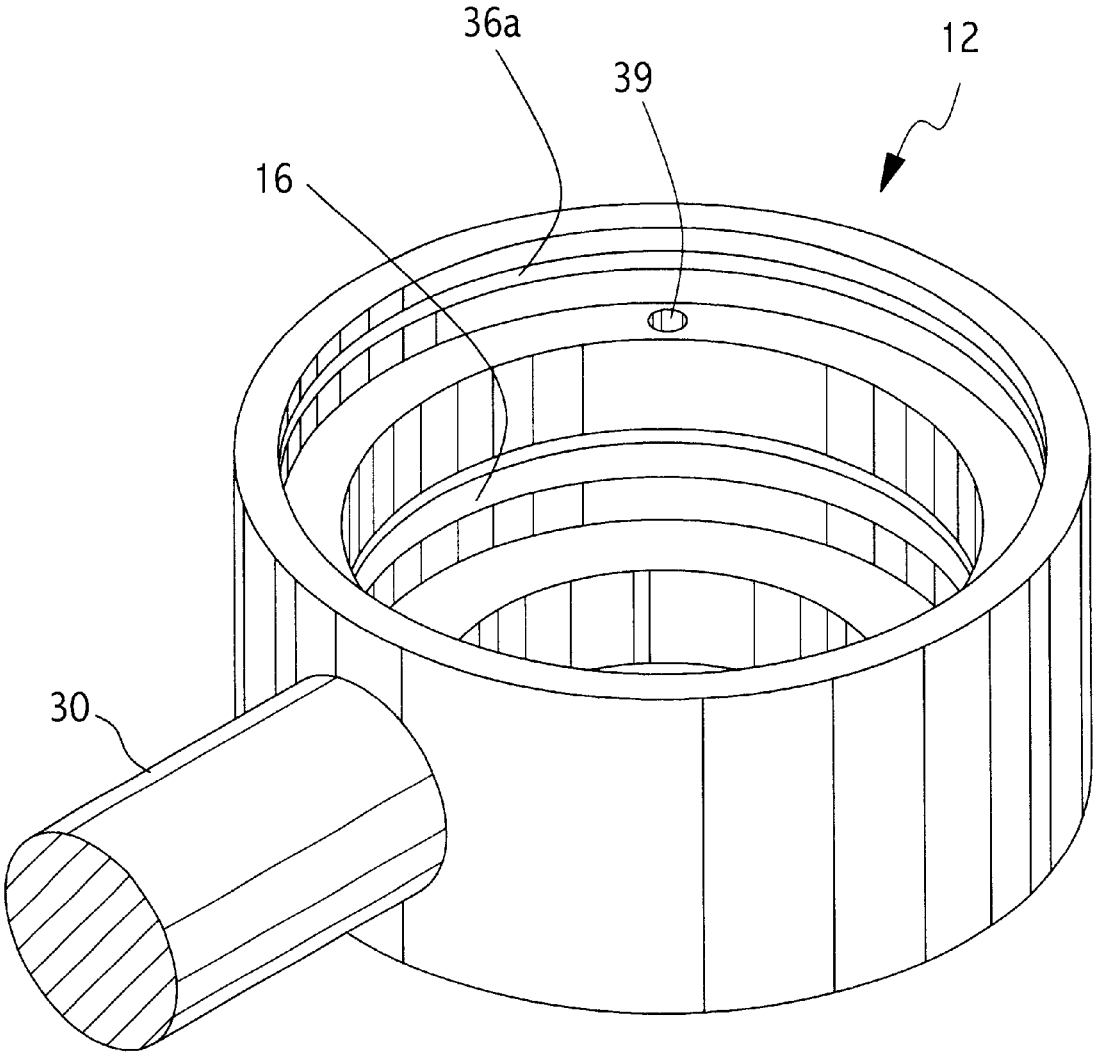
FIG. 7 shows the inside view of the driver head of the present invention.

Referring now to FIGS. 2 and 7, driver head 12 includes groove 16 for receiving sprag element 20 and groove 36*a* for receiving snap ring 36. Driver head 12 further includes bore 39 for receiving ball bearing (not shown) for locking and setting ratchet tool 10 in either the clockwise, counterclockwise or neutral positions.

Figure 8A:
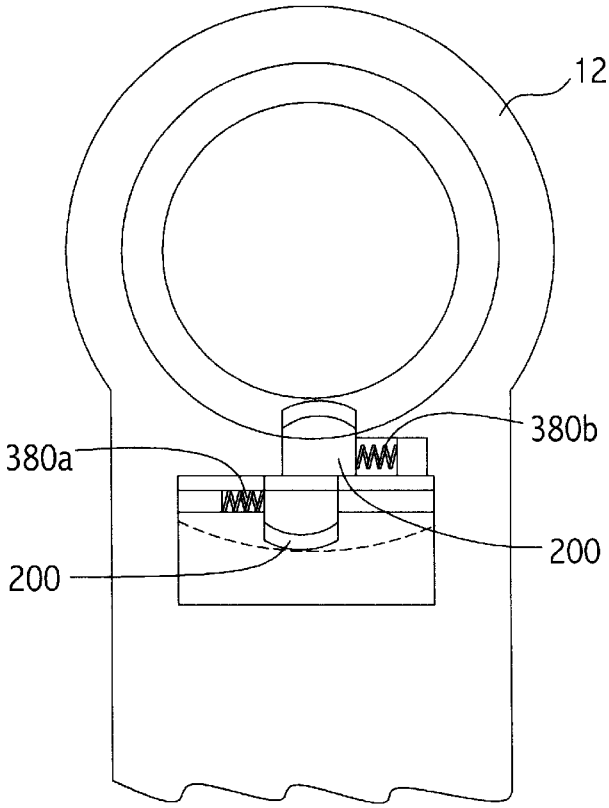
FIG. 8A shows a first alternate embodiment of the present invention.
Figure 8B:
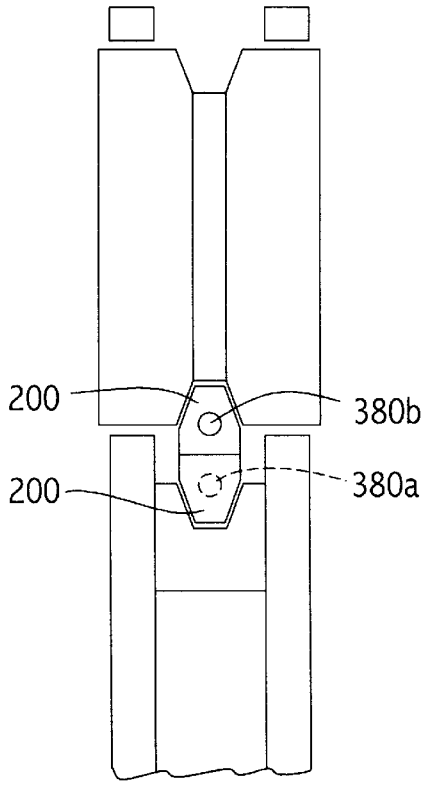
FIG. 8B shows a side view of FIG. 8A.

Referring now to FIGS. 8A and 8B, a two-way ratchet tool with free running neutral position consists of essentially the same components as the two-way ratchet with a locking neutral position. For the free-running neutral position, a pair of springs 380*a* and 380*b* is used on each sprag means 200. Spring 380*a* provides a preload to sprag means 200 while spring 380*b*, the positioning spring, is attached to the cover and serves the same purpose as dowel pins 29 of the preferred embodiment. In the neutral position, the force of positioning spring 380*b* overpowers the force of preload spring 380*a* and thereby disengages sprag means 200. Rotating the cover so that the positioning spring further compresses causes it to continue to hold the sprag in the disengaged position. Rotating the cover in the opposite direction such that positioning spring 380*b* extends allows the force of preload spring 380*a* to overpower the force of positioning spring 380*b* and thus engages the sprag. Therefore, this arrangement allows for rotation only in one direction and locking only in one direction.

Figure 9A:
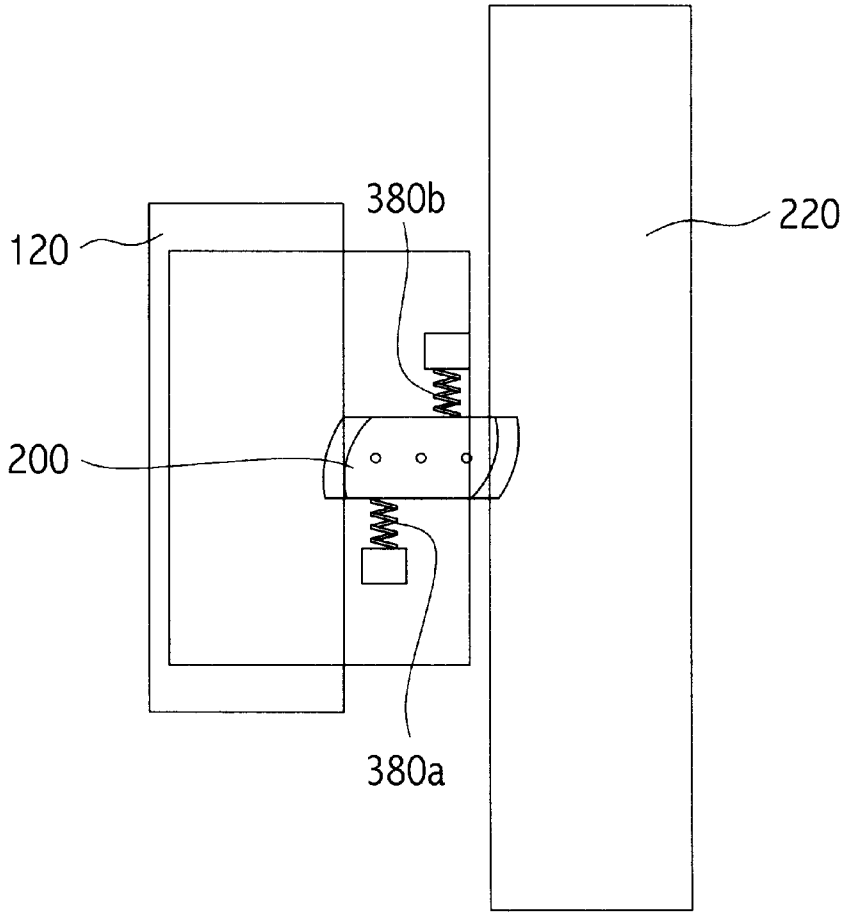
FIG. 9A shows a second alternate embodiment of the present invention.
Figure 9B:
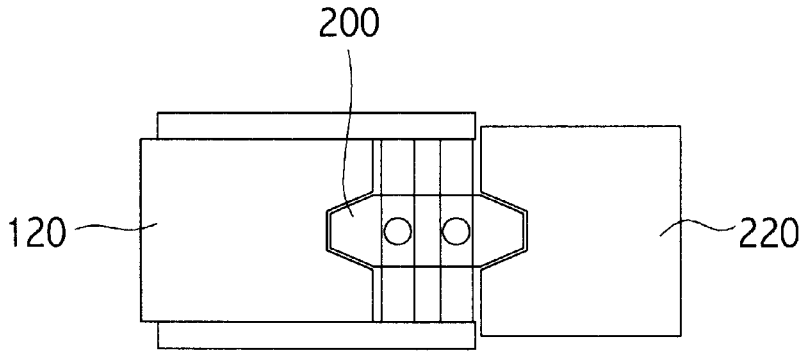
FIG. 9B shows a side view of FIG. 9A of the present invention.

Referring now to FIGS. 9A and 9B, in a linear ratchet device, the mechanism would consist of two rails 120 and 220 sprag element 200, preload spring 380*a* and positioning spring 380*b*. This arrangement is analogous to that shown in FIGS. 8A and 8B in that the device allows for movement in one direction only and locking in one direction only.

We claim:

1. A ratcheting device comprising:

a driver head that includes at least two 3-D sprag means positioned within a first groove within said driver head wherein one of said at least two 3-D sprag means may lockingly engage said first groove when said driver head is rotated in a first direction;

a hub assembly positioned within said driver head including a second groove;

a preload spring means passing through a bore of said one of at least two 3-D sprag means so as to facilitate rotation of said hub assembly in said first direction while preventing rotation of said hub assembly in a second direction;

a neck integrally formed with said driver head; and a handle means integrally formed with said neck wherein said handle may cause the driver head to rotate in said first and second directions.

2. The device of claim 1 wherein said preload spring means biases said one of at least two 3-D sprag means in a direction opposite rotation of said driver head.

3. The device of claim 1 wherein each of said 3-D sprag means includes at least two bores so as to allow for seating and biasing said 3-D sprag means.

4. The device of claim 3 wherein said preload spring means passes through a bore of each said 3-D sprag means.

5. The device of claim 4 wherein said preload spring means biases said two 3-D sprag means into engagement with said hub assembly.

6. A ratcheting device comprising:

a driver head that includes at least two 3-D sprag means positioned within a first groove within said driver head wherein one of said at least two 3-D sprag means may lockingly engage said first groove when said driver head is rotated in a first direction;

a hub assembly positioned within said driver head including a second groove;

a preload spring means passing through a first bore of each of said two 3-D sprag means so as to bias said two 3-D sprag means into engagement with said hub assembly;

a dowel pin passing through a second bore of each of said 3-D sprag means so as to facilitate a pivoting of each of said sprag means;

a neck integrally formed with said driver head; and a handle means integrally formed with said neck wherein said handle may cause the driver head to rotate in a first and a second directions.

7. The device of claim 6 wherein said hub assembly may rotate in said first and said second direction with respect to said driver head.

8. The device of claim 6 wherein said hub assembly may rotate only in said first direction with respect to said driver head.

9. The device of claim 6 wherein said hub assembly may rotate only in said second direction with respect to said driver head.

10. The device of claim 6 wherein said hub assembly can not rotate with respect to said driver head in said first direction or said second direction.

* * * * *